US006357652B1

(12) United States Patent
Evans et al.

(10) Patent No.: US 6,357,652 B1
(45) Date of Patent: Mar. 19, 2002

(54) EXTENSION BOX AND SHIPPING CARTON SYSTEM

(75) Inventors: Timothy M. Evans; Michael T. Miller, both of Austin, TX (US)

(73) Assignee: Dell Products, LP, Round Rock, TX (US)

( * ) Notice: Subject to any disclaimer, the term of this patent is extended or adjusted under 35 U.S.C. 154(b) by 0 days.

(21) Appl. No.: 09/570,003

(22) Filed: May 12, 2000

(51) Int. Cl.[7] ..... B65D 21/028; B65B 1/60

(52) U.S. Cl. ..... 229/120.01; 220/23.4; 229/125.39; 493/116; 493/383

(58) Field of Search ..... 229/120.01, 120.08, 229/120.21, 120.32, 125.39, 915; 220/23.2, 23.4; 493/116, 117, 114, 383, 393

(56) References Cited

U.S. PATENT DOCUMENTS

| | | | | | |
|---|---|---|---|---|---|
| 2,046,751 | A | * | 7/1936 | Reichel | 229/120.01 |
| 2,327,529 | A | | 8/1943 | Kieckhefer et al. | |
| 2,594,628 | A | * | 4/1952 | Evans | 229/915 |
| 3,058,644 | A | * | 10/1962 | Zastrow | 229/120.01 |
| 3,160,341 | A | * | 12/1964 | Cherney | 229/120.01 |
| 4,541,526 | A | * | 9/1985 | Berg et al. | 229/120.32 |
| 4,971,242 | A | * | 11/1990 | LaNicca | 229/120.21 |
| 5,197,660 | A | | 3/1993 | Colling | |
| 5,251,748 | A | * | 10/1993 | Adams et al. | 220/23.4 |
| 5,299,733 | A | | 4/1994 | Werth | |
| 5,318,223 | A | | 6/1994 | Gale | |
| 5,533,667 | A | | 7/1996 | Gale | |
| 5,549,241 | A | * | 8/1996 | Correll | 229/120.01 |
| 6,230,969 | B1 | * | 5/2001 | Spransy | 220/23.4 |

FOREIGN PATENT DOCUMENTS

| | | | | |
|---|---|---|---|---|
| EP | 296847 | A2 | * 12/1988 | 229/120.01 |

* cited by examiner

*Primary Examiner*—Gary E. Elkins
(74) *Attorney, Agent, or Firm*—Russell D. Culbertson; Shaffer & Culbertson, LLP

(57) ABSTRACT

A shipping carton (10) is formed from a primary box (11) and an extension box (12) adapted to be joined together in a connected position. The primary box (11) may contain a base product while the extension box (12) provides room for optional items which may be purchased together with the base product. When joined together in the connected position, the combined boxes provide the unitary shipping carton (10) which accommodates both the base product and optional items. The extension box (12) includes at least two stabilizing tabs (16, 17). The stabilizing tabs (16, 17) extend from a connecting side (32) of the extension box (12) which is adapted to abut a side of the primary box (11) when the boxes are in the connected position. The stabilizing tabs (16, 17) function to stabilize the extension box (12) from lateral movement with respect to the primary box (11).

18 Claims, 5 Drawing Sheets

EXTENSION BOX AND SHIPPING CARTON SYSTEM

TECHNICAL FIELD OF THE INVENTION

This invention relates to product shipping cartons. More particularly, the invention relates to a shipping carton system which provides additional capacity for shipping various related products. The invention encompasses an extension box and a carton system which utilizes the extension box along with a primary box. The invention further encompasses a method for forming a unitary shipping carton.

BACKGROUND OF THE INVENTION

Many types of products may be customized for a particular consumer and then shipped directly to the consumer. For example, portable computers may be shipped with a number of different accessories such as power supplies, chargers, additional drives, and various software media along with hard copy manuals and documentation. The highly customizable nature of these types of products combined with the practice of shipping products directly to the consumer creates problems in the design of shipping cartons or packages for the products. Ideally, shipping cartons should be as compact as possible in order to save shipping costs and the cost of the carton itself. Also, minimizing shipping carton size is desirable for environmental reasons.

One solution to the shipping carton issue for highly customizable products is to design a single carton or box large enough to accommodate any configuration in which the product may be shipped. This solution is wasteful of the material used for the one-size-fits-all box, and wasteful of the material required inside the box for stabilizing the various configurations which may be shipped.

Another solution to the packaging problem is to have a different shipping carton for each different product configuration that could be ordered. This solution is, however, expensive both in terms of the number of cartons which must be designed and in terms of the number of cartons which must be held in inventory. Also, it may be difficult to match the appropriate shipping carton with a particular product configuration during or after the product is assembled.

Yet another solution for packaging highly customizable products for shipping is to use one small carton for the base product and then completely separate cartons for each optional item which may be purchased along with the base product. However, this solution raises the problem of shipping the resulting multiple cartons to the purchaser and may increase shipping costs.

SUMMARY OF THE INVENTION

It is an object of the invention to provide a shipping carton system and extension box which overcome the above-described problems and others associated with shipping highly customizable products, particularly computers and related products. Another object of the invention is to provide a method for forming a unitary shipping carton.

A shipping carton system according to the invention includes a primary box and an extension box adapted to be joined together in a connected position. The primary box is adapted to contain a base product while the extension box provides room for optional items which may be purchased together with the base product. When joined together in the connected position, the combined boxes provide a unitary shipping carton which accommodates both the base product and optional items.

The extension box includes at least two stabilizing tabs. The stabilizing tabs extend from a connecting side of the extension box which is adapted to abut a side of the primary box when the boxes are in the connected position. For example, the two stabilizing tabs may comprise first and second lateral stabilizing tabs which extend parallel to each other from the connecting side of the extension box. The stabilizing tabs may be adapted to extend into tab receiving slots formed on the primary box. Regardless of how the stabilizing tabs are captured on the primary box, the tabs function to stabilize the extension box from lateral movement with respect to the primary box. In the preferred form of the invention, a stabilizing tab is located on each side of the extension box which meets the primary box when the boxes are in the connected position. Also, at least one of the stabilizing tabs is preferably adapted to be captured under major flaps included on the primary box.

The extension box includes a container portion which may comprise a complete enclosure for optional items. Alternatively, the container portion may include an open area on the connecting side adapted to abut the primary box when the boxes are in the connected position. When an open area is included on the connecting side of the extension box, the extension box preferably includes at least one stop element. Each stop element presents a surface in the plane of the connecting side of the extension box, and abuts a side of the primary box when the boxes are in the connected position. In this position, each stop element helps resist forces tending to crush the extension box into the side of the primary box.

The method for forming a unitary shipping carton according to the invention includes connecting the primary box and extension box with the stabilizing tabs extending into the respective tab receiving slots formed on the primary box. Once the boxes are in the connected position, the method includes applying adhesive tape to secure the two boxes together. This step includes applying tape over a first side of the primary box, across a junction between the two boxes, and over a first side of the extension box. The tape applying step also includes applying tape across a second side of the primary box opposite the first side, across the junction between the two boxes, and across a second side of the extension box.

The shipping carton system according to the invention facilitates using a relatively small box for a base product, but allows various optional items to be packaged together with the base product and shipped in a unitary carton. The invention reduces carton materials and inventory. Also, the shipping carton system requires no special taping equipment. The unitary carton may be taped together using the same taping equipment used for the primary box.

These and other objects, advantages, and features of the invention will be apparent from the following description of the preferred embodiments, considered along with the accompanying drawings.

DESCRIPTION OF THE PREFERRED EMBODIMENTS

Figure 1:
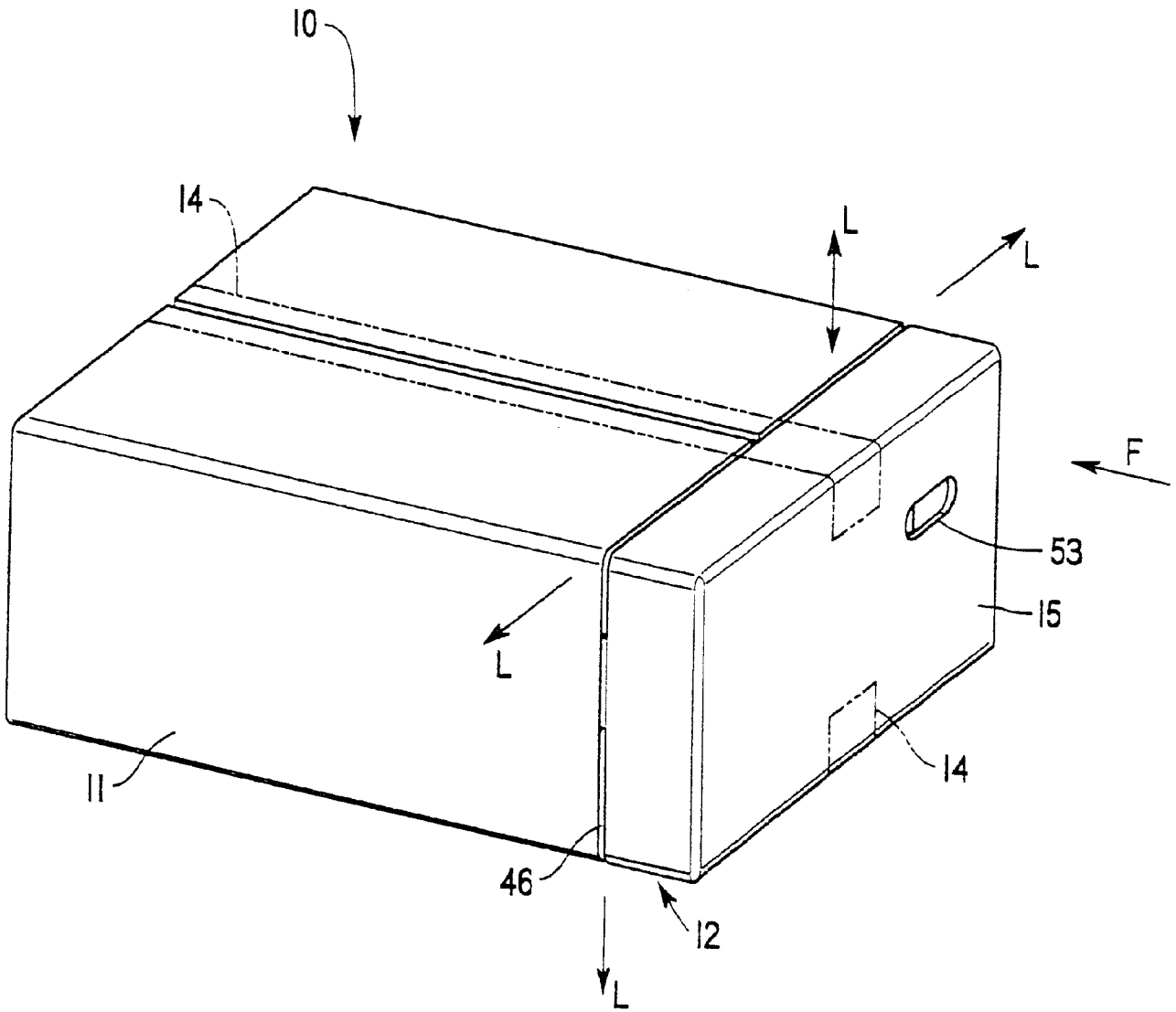
FIG. 1 is an isometric view of a unitary shipping carton embodying the principles of the invention, with adhesive tape shown in phantom.
Figure 2:
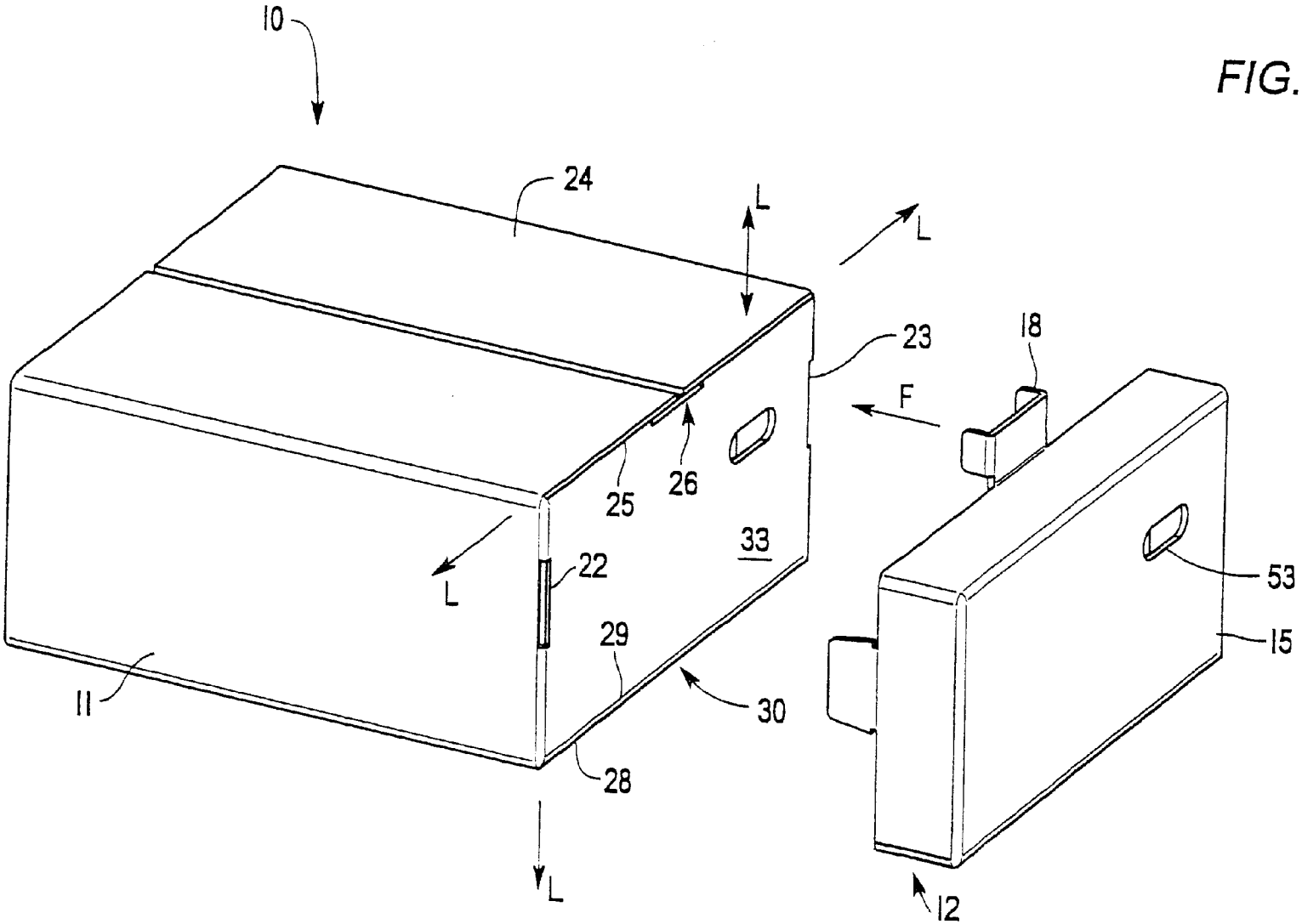
FIG. 2 is an exploded isometric view showing the primary box and extension box which make up the unitary carton shown in FIG. 1.

Referring to FIGS. 1 and 2, a unitary shipping carton 10 is formed from two separate boxes, a primary box 11 and an extension box 12. FIG. 1 shows primary box 11 and extension box 12 in a connected position and taped together with adhesive tape 14 to form carton 10. Boxes 11 and 12 may be made from any suitable material, and preferably corrugated cardboard or other suitable shipping carton material. Although not limited to any particular use, shipping carton 10 is suitable for shipping customizable products such as portable computers. The base product, that is, the portable computer itself (not shown) may be contained in primary box 11 along with any other components which are always shipped with the base product. Extension box 12 is suitable for containing optional accessories and documentation (not shown).

Although the form of the invention illustrated for purposes of example in the figures depicts primary box 11 as being larger than extension box 12 in order to accommodate a base product, the primary box need not be larger, and may in fact be smaller than the extension box. Regardless of the respective size of the two boxes, either box may be adapted to contain a base product and the other box may be adapted to contain optional items for that base product. Also, extension box 12 need not connect to a short side of primary box 11 shown in the illustrated example. Furthermore, the invention is not limited to rectangular shipping cartons. The primary and extension boxes, and the resulting unitary carton may be substantially any shape to fit the desired application.

Figure 3:
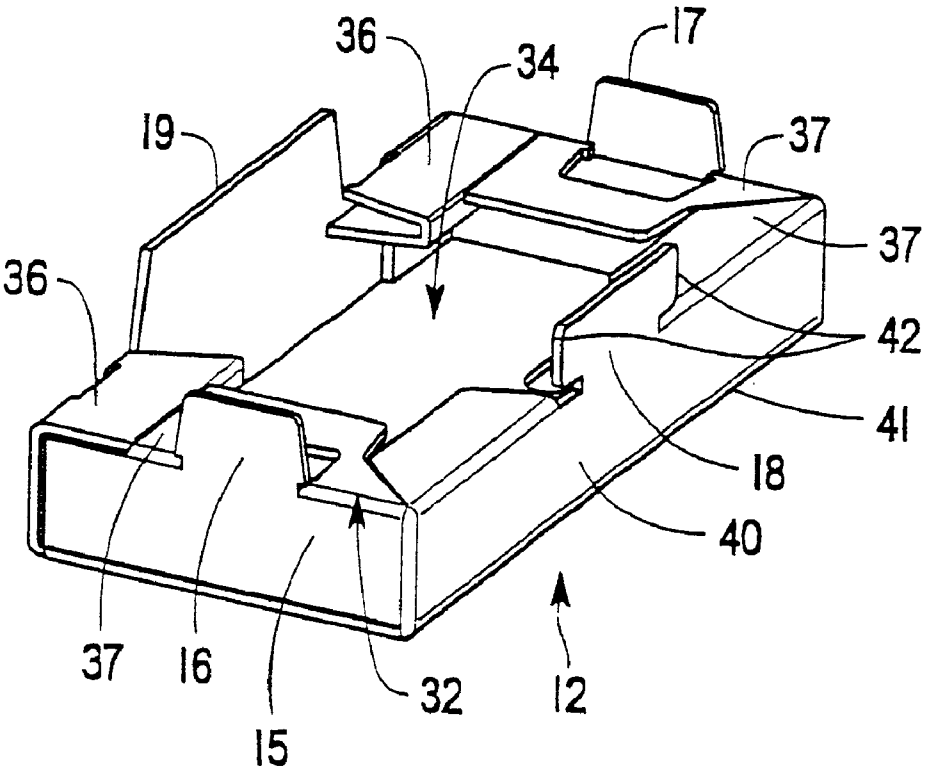
FIG. 3 is an isometric view of the extension box from a perspective showing the connecting side of the box.

Referring to FIGS. 2 and 3, extension box 12 includes a container portion shown generally at reference numeral 15 and a number of the stabilizing tabs. The illustrated form of the invention includes first and second lateral stabilizing tabs, 16 and 17, respectively, along with a top stabilizing tab 18 and a bottom stabilizing tab 19. Although the example of the invention shown in the drawings is preferred, other forms of the invention may include as few as two spaced apart stabilizing tabs.

When in the connected position shown in FIG. 1, each stabilizing tab 16, 17, 18, and 19 cooperates with primary box 11 to prevent or resist lateral movement between the two boxes, that is, movement in the direction of arrows L shown in FIG. 1. Primary box 11 preferably includes a separate tab receiving slot for receiving each stabilizing tab extending from extension box 12. As shown in FIG. 2, the illustrated primary box 11 includes first and second lateral slots 22 and 23, respectively, for receiving first and second lateral stabilizing tabs 16 and 17 in the connected position. Also, the major flaps 24 at the top of primary box 11 fold down to the top edge 25 of the primary box to define a top slot 26 for receiving top stabilizing tab 18. Similarly major flaps 28 at the bottom of the primary box 11 fold down to a bottom edge 29 of the primary box to define a bottom slot 30 for receiving bottom stabilizing tab 19. The connection between the two boxes 11 and 12 will be described further below with reference to FIGS. 1 and 4.

As shown in FIG. 3, container portion 15 includes a connecting side indicated generally at reference numeral 32 adapted to abut a side 33 (FIG. 2) of primary box 11 when the boxes are in the connected position. Connecting side 32 includes an open area 34. Other forms of the invention may include an extension box which forms a complete enclosure with no open side or area such as area 34. However, open area 34 reduces the material required for extension box 12. The container portion 15 of extension box 12 combines with side 33 of primary box 11 to form a complete enclosure for materials to be placed in the extension box.

In this preferred embodiment, stop elements 36 are included on extension box 12. Each stop element 36 presents a surface lying in the plane of the connecting side 32 of extension box 12. Stop elements 36 increase the structural rigidity of extension box 12 and also help prevent extension box 12 from being crushed into the primary box when a force is applied along line F in FIG. 1. Other fold downs 37 on extension box 12 help increase structural rigidity of the box but do not necessarily provide the resistance to crushing provided by stop elements 36.

Figure 4:
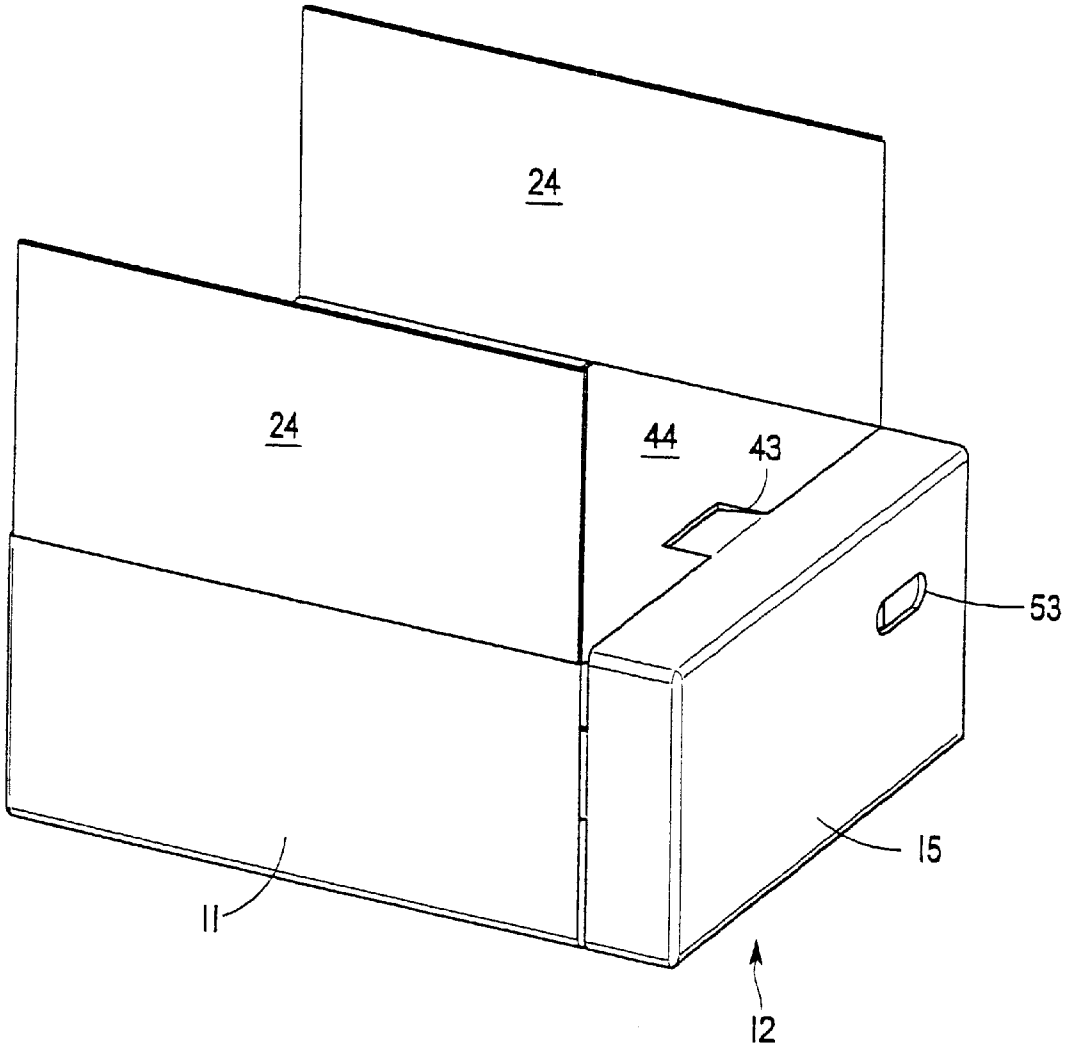
FIG. 4 is an isometric view similar to FIG. 2 but showing the extension box in the connected position prior to folding the major flaps of the primary box.

Referring still to FIG. 3, the top side of extension box 12 comprises a lid 40 for the extension box which pivots about pivot connection 41. Top tab 18 is positioned on the side of lid 40 opposite pivot connection 41 and extends from connecting side 32 when the lid is in the closed position shown in FIG. 3. Also, top tab 18 preferably includes wings 42 which are adapted to cooperate with a receptacle feature 43 on primary box 11 as shown in FIG. 4. FIG. 4 illustrates that the method for forming carton 10 includes first inserting the lateral and bottom stabilizing tabs 16, 17, and 19 into their respective receiving slots 22, 23, and 30 on primary box 11. In this position in the illustrated form of the invention, the minor flaps 44 at the top of primary box 11 are closed and extension box lid 40 is closed to insert top tab 18 and wings 42 through receptacle feature 43 included on the minor flaps 44. Wings 42 may then expand to hold tab 18 in the connected position. Major flaps 24 at the top of primary box 11 may then be closed to capture top stabilizing tab 18 as shown in FIG. 1. Capturing at least one stabilizing tab with major flaps of the primary box helps provide a secure connection between the two boxes 11 and 12.

Finally, carton 10 is sealed using a suitable sealing method, preferably the adhesive tape 14 shown in FIG. 1. The preferred adhesive tape is applied over a first side or top of primary box 11, across a junction 46 between the two boxes, and over the top side or lid 40 of extension box 12. Adhesive tape is similarly applied over the bottom or second side of primary box 11, across junction 46 between the two boxes, and over a bottom side of extension box 12. Since boxes such as primary box 11 are commonly taped along the junction of the major flaps, tape 14 is also preferably applied along the junction of the major flaps at the top and bottom of the box as shown in FIG. 1, with the tape extending further over the top 40 of extension box 12 and somewhat over the end of the extension box. Generally, the same taping equipment used to tape primary box 11 alone can be used to tape the combined boxes 11 and 12 to form unitary shipping carton 10.

The illustrated, preferred form of the invention utilizing tab receiving slots on the primary box 11, has the advantage that the stabilizing tabs 16, 17, 18, and 19 cooperate with the tab receiving slots simply by inserting each tab in the respective slot. No adhesive or other connecting material is required at the stabilizing tabs themselves. An alternative form of the invention does not require separate tab receiving slots 22 and 23. In this alternate form of the invention, at least some of the stabilizing tabs may be connected to the primary box with adhesive, tape, or staples. This alternate embodiment of the invention is to be considered within the scope of the following claims unless otherwise indicated in the particular claim.

Figure 5:
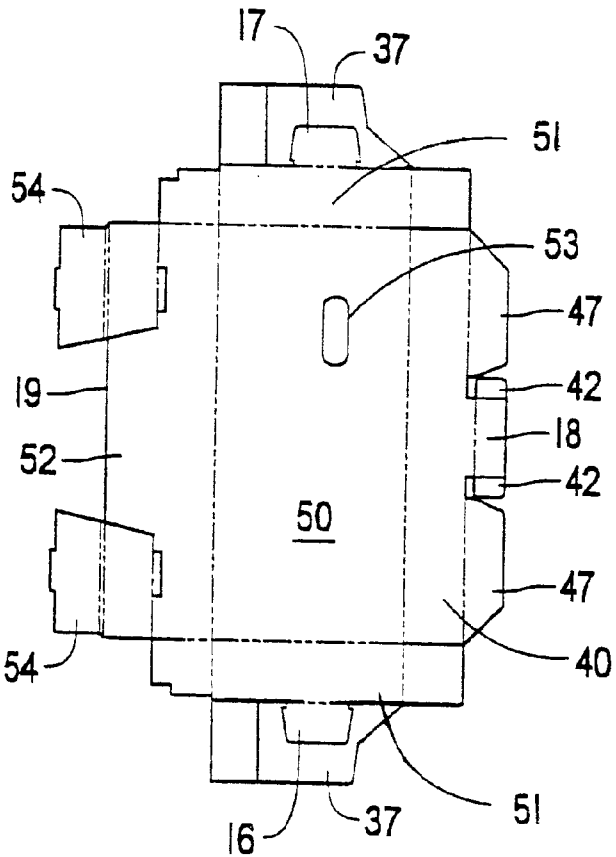
FIG. 5 is a plan view of a blank piece of carton material which may be folded into the extension box shown in FIG. 4.

FIG. 5 shows a sheet of material from which the preferred extension box 12 may be formed. The sheet may be stamped out of a blank piece of material using suitable stamping equipment and includes a primary side or panel 50, end panels 51, a top forming lid 40, and bottom 52. Hand hold 53 may also be stamped out to provide a convenient location for holding the resulting carton 10 for lifting. Fold downs 54 are used to create stop elements 36 shown in FIG. 3. Additional fold downs 37 may also be stamped out of the blank sheet of material. Once folded, fold downs 54 and 37 leave the lateral tabs 16 and 17, top tab 18, and bottom tab 19 extending from the connecting side 32 of extension box 11 as shown particularly in FIG. 3.

The above described preferred embodiments are intended to illustrate the principles of the invention, but not to limit the scope of the invention. Various other embodiments and modifications to these preferred embodiments may be made by those skilled in the art without departing from the scope of the following claims.

What is claimed is:

1. An extension box for joining with a primary box in a connected position to provide a unitary carton for shipping, the extension box comprising:

(a) a container portion having a connecting side which abuts the primary box when the extension box and primary box are in the connected position;

(b) at least two stabilizing tabs extending from the connecting side of the container portion at spaced apart locations on the connecting side;

(c) an extension box lid connected to a panel of the extension box through a pivot connection; and (d) a top stabilizing tab extending from the extension box lid at the connecting side of the container portion when the extension box lid is in a closed position.

2. The extension box of claim 1 wherein the connecting side of the container portion encompasses an open area and the extension box further includes:

(a) at least one stop element, each stop element presenting a surface in a plane defining the connecting side of the container portion.

3. The extension box of claim 2 further including:

(a) at least one fold down element at the periphery of the open area.

4. The extension box of claim 1 wherein:

(a) at least one of the stabilizing tabs extends into a respective tab receiving slot on the primary box when the primary box and extension box are in the connected position.

5. The extension box of claim 1 further including:

(a) a first lateral stabilizing tab located on a first lateral side of the extension box; and (b) a second lateral stabilizing tab located on a second lateral side of the extension box and extending substantially parallel to the first lateral stabilizing tab.

6. The extension box of claim 1 further including:

(a) a bottom stabilizing tab extending from a bottom edge of the extension box adjacent a bottom side of the extension box, the bottom side of the extension box being opposite to the extension box lid.

7. The extension box of claim 6 further including:

(a) a first lateral stabilizing tab located on a first lateral side of the extension box, the first lateral side extending between the bottom side of the extension box and the extension box lid in the closed position; and (b) a second lateral stabilizing tab located on a second lateral side of the extension box and extending substantially parallel to the first lateral stabilizing tab, the second lateral side extending between the bottom side of the extension box and the extension box lid in the closed position.

8. A shipping carton system comprising:

(a) a primary box with a top set of flaps, the top set of flaps folding to a closed position along a top edge of the primary box;

(b) an extension box for joining with the primary box in a connected position to provide a unitary carton for shipping, the extension box including a container portion having a connecting side which abuts the primary box when the extension box and primary box are in the connected position;

(c) a top stabilizing tab which extends across the top edge of the primary box when the primary box and the extension box are in the connected position, the top stabilizing tab then being in position to allow the top set of flaps on the primary box to fold to their closed position and capture the top stabilizing tab; and (d) at least two additional stabilizing tabs extending from the connecting side of the container portion at spaced apart locations on the connecting side.

9. The shipping carton system of claim 8 wherein the connecting side of the container portion encompasses an open area and the extension box further includes:

(a) at least one stop element, each stop element presenting a surface in a plane defining the connecting side of the container portion.

10. The shipping carton system of claim 9 further including:

(a) at least one fold down element at the periphery of the open area.

11. The shipping carton system of claim 8 further including:

(a) at least one tab receiving slot on the primary box, each tab receiving slot in position to receive a different one of the additional stabilizing tabs on the extension box when the primary box and extension box are in the connected position.

12. The shipping carton system of claim 8 further including:

(a) two substantially parallel extending lateral tab receiving slots on the primary box; and (b) wherein the at least two additional stabilizing tabs on the extension box include two substantially parallel-extending, lateral stabilizing tabs, each lateral stabilizing tab extending into a different one of the lateral tab receiving slots on the primary box when the primary box and extension box are in the connected position.

13. The shipping carton system of claim 8 further including:

(a) a bottom set of flaps on the primary box, the bottom set of flaps being located on a side of the primary box opposite to the side having the top set of flaps and folding to a closed position along a bottom edge of the primary box to form a bottom slot; and (b) a bottom stabilizing tab on the extension box which extends into the bottom slot of the primary box when the primary box and extension box are in the connected position.

14. The shipping carton system of claim 13 further including:

(a) two substantially parallel-extending lateral tab receiving slots on the primary box, the lateral tab receiving slots being located on a side of the primary box extending between the top and bottom sides of the primary box; and (b) two substantially parallel-extending lateral stabilizing tabs on the extension box, each lateral stabilizing tab extending into a different one of the lateral tab receiving slots on the primary box when the primary box and extension box are in the connected position.

15. A method for forming a unitary shipping carton from a primary box and an extension box, the method including the steps of:

(a) placing the primary box and extension box in a connected position with at least two spaced apart stabilizing tabs on the extension box extending into corresponding tab receiving slots on the primary box;

(b) applying adhesive tape from a first side of the primary box, across a junction between the extension box and the primary box, and over a first side of the extension box; and (c) applying adhesive tape from a second side of the primary box, across the junction between the extension box and the primary box, and over a second side of the extension box, the second side of the primary box being opposite to the first side of the primary box and the second side of the extension box being opposite to the first side of the extension box.

16. The method of claim 15 herein the step of applying adhesive tape from the first side of the primary box, across the junction between the extension box and the primary box, and over the first side of the extension box includes the step of:

(a) extending the adhesive tape along a junction of flaps on the first side of the primary box and continuing the adhesive tape over the first side of the extension box.

17. The method of claim 16 wherein the step of applying adhesive tape from the second side of the primary box, across the junction between the extension box and the primary box, and over the second side of the extension box includes the step of:

(a) extending the adhesive tape along a junction of flaps on the second side of the primary box and continuing the adhesive tape over the second side of the extension box.

18. The method of claim 15 further including step of:

(a) capturing at least one of the stabilizing tabs under major flaps included on one side of the primary box.

* * * * *